US010524634B2

(12) United States Patent
Digman

(10) Patent No.: US 10,524,634 B2
(45) **Date of Patent: *Jan. 7, 2020**

(54) DISHWASHER WITH COMBINED LIQUID AND AIR SPRAYERS

(71) Applicant: Midea Group Co., Ltd., Beijiao, Shunde, Foshan (CN)

(72) Inventor: Robert M. Digman, Goshen, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 33 days.

This patent is subject to a terminal disclaimer.

(21) Appl. No.: 15/721,091

(22) Filed: Sep. 29, 2017

(65) Prior Publication Data

US 2019/0099056 A1 Apr. 4, 2019

(51) Int. Cl.

| | |
|---|---|
| ***A47L 15/46*** | (2006.01) |
| ***A47L 15/23*** | (2006.01) |
| ***A47L 15/42*** | (2006.01) |
| ***A47L 15/44*** | (2006.01) |
| ***A47L 15/48*** | (2006.01) |
| ***A47L 15/50*** | (2006.01) |

(52) U.S. Cl.

CPC ..... *A47L 15/46* (2013.01); *A47L 15/23* (2013.01); *A47L 15/4221* (2013.01); *A47L 15/4225* (2013.01); *A47L 15/4285* (2013.01); *A47L 15/4293* (2013.01); *A47L 15/449* (2013.01); *A47L 15/486* (2013.01); *A47L 15/507* (2013.01); *A47L 2501/01* (2013.01); *A47L 2501/04* (2013.01); *A47L 2501/12* (2013.01); *A47L 2501/20* (2013.01)

(58) Field of Classification Search

CPC ..... A47L 15/46; A47L 15/23; A47L 15/4221; A47L 15/4225; A47L 15/4285; A47L 15/4293; A47L 15/449; A47L 15/486; A47L 15/507; A47L 2501/01; A47L 2501/04; A47L 2501/12; A47L 2501/20

USPC ..... 134/57 D

See application file for complete search history.

(56) References Cited

U.S. PATENT DOCUMENTS

| | | | |
|---|---|---|---|
| 2,734,520 | A | 2/1956 | Abresch |
| 2,808,063 | A | 10/1957 | Abresch et al. |
| 2,939,465 | A | 6/1960 | Kesling |
| 2,956,572 | A | 10/1960 | Levit et al. |
| 2,973,907 | A | 3/1961 | Abresch et al. |

(Continued)

FOREIGN PATENT DOCUMENTS

| | | | |
|---|---|---|---|
| CN | 2094961 | U | 2/1992 |
| CN | 1879547 | A | 12/2006 |

(Continued)

OTHER PUBLICATIONS

SCRIBD, Sears Kenmore Elite 2013 Stainless Steel Tall Tub Dishwasher Service Manual, www.scribd.com, Retrieved on Dec. 5, 2018.

(Continued)

*Primary Examiner* — Michael E Barr
*Assistant Examiner* — Tinsae B Ayalew
(74) *Attorney, Agent, or Firm* — Middleton Reutlinger

(57) ABSTRACT

A method and dishwasher utilize one or more sprayers that are coupled to both a liquid supply and an air supply through a common hydraulic circuit such that both liquid and pressurized air can be supplied to the one or more sprayers.

28 Claims, 9 Drawing Sheets

(56) References Cited

U.S. PATENT DOCUMENTS

| | | | | |
|---|---|---|---|---|
| 2,980,120 | A | 4/1961 | Jacobs | |
| 3,006,557 | A | 10/1961 | Jacobs | |
| 3,026,046 | A | 3/1962 | Wickham et al. | |
| 3,044,842 | A | 7/1962 | Abresch et al. | |
| 3,051,183 | A | 8/1962 | Jacobs | |
| 3,082,779 | A | 3/1963 | Jacobs | |
| 3,088,474 | A | 5/1963 | Leslie | |
| 3,101,730 | A | 8/1963 | Harris et al. | |
| 3,115,306 | A | 12/1963 | Graham | |
| 3,178,117 | A | 4/1965 | Hanifan | |
| 3,192,935 | A | 7/1965 | Hanifan | |
| 3,210,010 | A | 10/1965 | Delapena | |
| 3,324,867 | A | 6/1967 | Freese | |
| 3,348,775 | A | 10/1967 | Flame | |
| 3,361,361 | A * | 1/1968 | Schutte | A47L 15/23 134/179 |
| 3,454,784 | A | 7/1969 | Wantz et al. | |
| 3,538,927 | A | 11/1970 | Harald | |
| 3,586,011 | A | 6/1971 | Mazza | |
| 3,590,688 | A | 7/1971 | Brannon | |
| 3,596,834 | A | 8/1971 | Cushing | |
| 3,719,323 | A | 3/1973 | Raiser | |
| 4,175,575 | A | 11/1979 | Cushing | |
| 4,226,490 | A | 10/1980 | Jenkins et al. | |
| 4,398,562 | A | 8/1983 | Saarem et al. | |
| 4,718,440 | A | 1/1988 | Hawker et al. | |
| 4,732,323 | A | 3/1988 | Jarvis et al. | |
| 5,211,190 | A | 5/1993 | Johnson et al. | |
| 5,226,454 | A | 7/1993 | Cabalfin | |
| 5,341,827 | A | 8/1994 | Kim | |
| 5,697,392 | A | 12/1997 | Johnson et al. | |
| 5,725,002 | A | 3/1998 | Payzant | |
| 6,053,185 | A | 3/2000 | Cirjak et al. | |
| 6,431,188 | B1 | 8/2002 | Laszczewski, Jr. et al. | |
| 6,694,990 | B2 | 2/2004 | Spanyer et al. | |
| 6,869,029 | B2 | 3/2005 | Ochoa et al. | |
| 7,055,537 | B2 | 6/2006 | Elick et al. | |
| 7,210,315 | B2 | 5/2007 | Castelli et al. | |
| 7,293,435 | B2 | 11/2007 | Elexpuru et al. | |
| 7,445,013 | B2 | 11/2008 | VanderRoest et al. | |
| 7,464,718 | B2 | 12/2008 | McIntyre et al. | |
| 7,556,049 | B2 | 7/2009 | Oakes et al. | |
| 7,587,916 | B2 | 9/2009 | Rizzetto | |
| 7,594,513 | B2 | 9/2009 | VanderRoest et al. | |
| 7,607,325 | B2 | 10/2009 | Elexpuru et al. | |
| 7,650,765 | B2 | 1/2010 | Rizzetto | |
| 7,914,625 | B2 | 3/2011 | Bertsch et al. | |
| 7,935,194 | B2 | 5/2011 | Rolek | |
| 8,136,537 | B2 | 3/2012 | Cerrano et al. | |
| 8,191,560 | B2 | 6/2012 | Mallory et al. | |
| 8,443,765 | B2 | 5/2013 | Hollis | |
| 8,696,827 | B2 | 4/2014 | Ashrafzadeh et al. | |
| 8,858,729 | B2 | 10/2014 | Buddharaju et al. | |
| 8,900,375 | B2 | 12/2014 | Gnadinger et al. | |
| 8,915,257 | B2 | 12/2014 | Büsing et al. | |
| 8,932,411 | B2 | 1/2015 | Beaudet et al. | |
| 8,978,674 | B2 | 3/2015 | Buesing | |
| 8,985,128 | B2 | 3/2015 | Pyo et al. | |
| 9,121,217 | B1 | 9/2015 | Hoffberg | |
| 9,170,584 | B2 | 10/2015 | Lum et al. | |
| 9,204,780 | B2 | 12/2015 | Francisco et al. | |
| 9,220,393 | B2 | 12/2015 | Becker et al. | |
| 9,241,604 | B2 | 1/2016 | Dries | |
| 9,259,137 | B2 | 2/2016 | Boyer et al. | |
| 9,265,400 | B2 | 2/2016 | Bigott | |
| 9,307,888 | B2 | 4/2016 | Baldwin et al. | |
| 9,326,657 | B2 | 5/2016 | Thiyagarajan | |
| 9,480,389 | B2 | 11/2016 | Haft et al. | |
| 9,492,055 | B2 | 11/2016 | Feddema | |
| 9,532,700 | B2 | 1/2017 | Welch | |
| 9,635,994 | B2 | 5/2017 | Boyer et al. | |
| 9,655,496 | B2 | 5/2017 | Baldwin et al. | |
| 9,915,356 | B2 | 3/2018 | Chang et al. | |
| 9,958,073 | B2 | 5/2018 | Yang | |
| 2005/0011544 | A1 | 1/2005 | Rosenbauer et al. | |
| 2005/0139240 | A1 | 6/2005 | Bong et al. | |
| 2005/0241680 | A1 | 11/2005 | Noh | |
| 2005/0241681 | A1 | 11/2005 | Hwang | |
| 2006/0278258 | A1 | 12/2006 | Kara et al. | |
| 2008/0163904 | A1 | 7/2008 | Hwang | |
| 2008/0271765 | A1 | 11/2008 | Burrows | |
| 2008/0276975 | A1 | 11/2008 | Disch | |
| 2009/0071508 | A1 | 3/2009 | Sundaram et al. | |
| 2009/0090400 | A1 | 4/2009 | Burrows et al. | |
| 2009/0145468 | A1 | 6/2009 | Chericoni | |
| 2010/0043826 | A1 | 2/2010 | Bertsch et al. | |
| 2011/0186085 | A1 | 8/2011 | Chen et al. | |
| 2012/0060875 | A1 | 3/2012 | Fauth et al. | |
| 2012/0175431 | A1* | 7/2012 | Althammer | B08B 3/024 239/263 |
| 2012/0291827 | A1 | 11/2012 | Buddharaju et al. | |
| 2013/0000762 | A1 | 1/2013 | Buddharaju et al. | |
| 2013/0319483 | A1 | 12/2013 | Welch | |
| 2014/0059880 | A1 | 3/2014 | Bertsch et al. | |
| 2014/0069470 | A1* | 3/2014 | Baldwin | A47L 15/4246 134/107 |
| 2014/0373876 | A1 | 12/2014 | Feddema | |
| 2015/0007861 | A1 | 1/2015 | Azmi et al. | |
| 2015/0266065 | A1 | 9/2015 | Savoia | |
| 2016/0198928 | A1 | 7/2016 | Xu et al. | |
| 2017/0181599 | A1 | 6/2017 | Choi et al. | |
| 2017/0224190 | A1 | 8/2017 | Sakthivel et al. | |
| 2017/0273535 | A1 | 9/2017 | Roderick et al. | |
| 2017/0354308 | A1 | 12/2017 | Choi et al. | |
| 2018/0084967 | A1 | 3/2018 | Ross et al. | |
| 2018/0110397 | A1 | 4/2018 | Kim et al. | |
| 2018/0132692 | A1 | 5/2018 | Dries et al. | |
| 2018/0168425 | A1 | 6/2018 | Wilson et al. | |
| 2018/0192851 | A1 | 7/2018 | Gursoy et al. | |

FOREIGN PATENT DOCUMENTS

| | | | |
|---|---|---|---|
| CN | 101134198 | A | 3/2008 |
| CN | 201067392 | Y | 6/2008 |
| CN | 101795613 | A | 8/2010 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 104523208 | A | 4/2015 |
| CN | 104757921 | A | 7/2015 |
| CN | 204671085 | U | 9/2015 |
| CN | 105147218 | A | 12/2015 |
| CN | 105231971 | A | 1/2016 |
| CN | 205094364 | U | 3/2016 |
| DE | 3537184 | A1 | 4/1987 |
| DE | 10121083 | A1 | 10/2002 |
| DE | 10300501 | A1 | 7/2004 |
| DE | 202004013786 | U1 | 12/2004 |
| DE | 102008011743 | A1 | 9/2009 |
| DE | 202014010365 | U1 | 5/2015 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0864291 | A1 | 9/1998 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1758494 | A1 | 3/2007 |
| EP | 2636786 | A1 | 9/2013 |
| EP | 2059160 | B1 | 3/2015 |
| FR | 1473796 | A | 3/1967 |
| GB | 572623 | A | 10/1945 |
| GB | 2244209 | A | 11/1991 |
| JP | 2003339607 | A | 12/2003 |
| JP | 2014121353 | A | 7/2014 |
| KR | 100786069 | B1 | 12/2007 |
| KR | 101173691 | B1 | 8/2012 |
| KR | 200464747 | Y1 | 1/2013 |

(56) References Cited

FOREIGN PATENT DOCUMENTS

| | | | |
|---|---|---|---|
| WO | WO2009008827 | A1 | 1/2009 |
| WO | 2016008699 | A1 | 1/2016 |
| WO | 2018053635 | A1 | 3/2018 |

OTHER PUBLICATIONS

EVERYSPEC, Federal Specification: Dishwashing Machines, Single Tank and Double Tank, Commercial, www.everyspec.com, Oct. 17, 1983.
Transmittal of Related Applications dated Apr. 29, 2019.
Transmittal of Related Applications dated Sep. 17, 2018.
Electrolux Home Products, Inc. "Dishwasher Use & Care Guide 1500 Series with Fully Electronic Control" 2003.
International Search Report and Written Opinion issued in Application No. PCT/CN2018/074294 dated Jul. 5, 2018.
International Search Report and Written Opinion issued in Application No. PCT/CN2018/074268 dated Jul. 13, 2018.
International Search Report and Written Opinion issued in Application No. PCT/CN2019/078611 dated Jun. 5, 2019.
International Search Report and Written Opinion issued in Application No. PCT/CN2019/079236 dated Jun. 25, 2019.
International Search Report and Written Opinion issued in Application No. PCT/CN2019/078799 dated Jun. 26, 2019.
International Search Report and Written Opinion issued in Application No. PCT/CN2019/078612 dated Jun. 28, 2019.
U.S. Patent Office; Non-Final Office Action issued in Application No. 15/721,099 dated Jul. 30, 2019.
DE10121083A1 machine translation (Year: 2002).

* cited by examiner

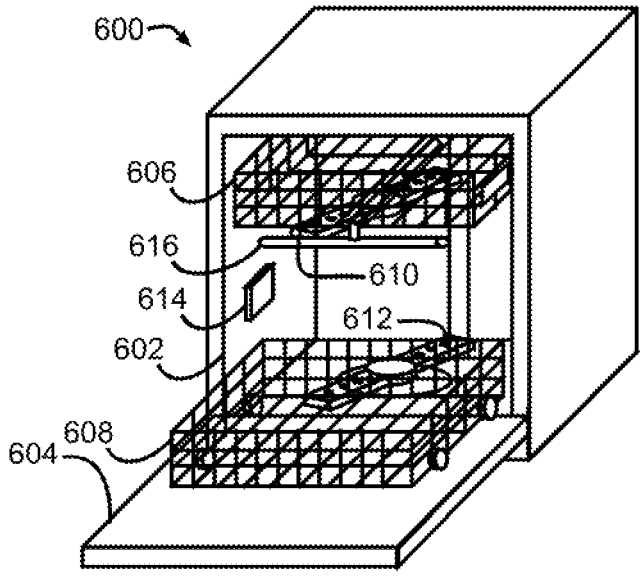
FIG. 24
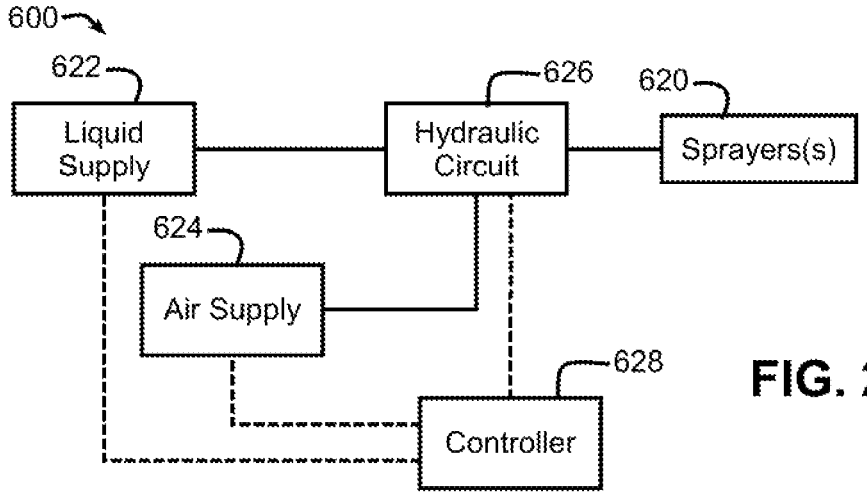
FIG. 25
FIG. 26
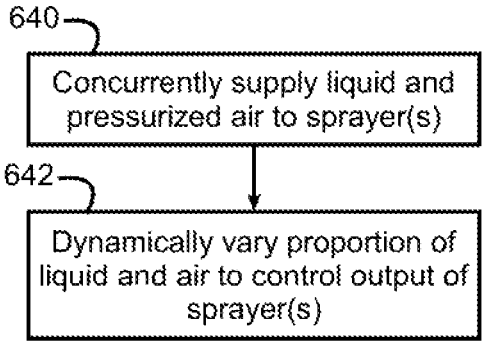

DISHWASHER WITH COMBINED LIQUID AND AIR SPRAYERS

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the short coming of that they must spread the wash fluid over all areas equally to achieve a satisfactory result. In doing so resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

SUMMARY

The herein-described embodiments address these and other problems associated with the art by providing a method and dishwasher utilizing one or more sprayers that are coupled to both a liquid supply and an air supply through a common hydraulic circuit such that both liquid and pressurized air can be supplied to the one or more sprayers. In some instances, liquid and pressurized air may be supplied at different times, e.g., during wash and drying cycles, while in other instances liquid and pressurized air may be supplied concurrently.

Therefore, consistent with one aspect of the invention, a dishwasher may include a wash tub, one or more sprayers disposed within the wash tub, a liquid supply in fluid communication with the one or more sprayers and configured to supply a liquid to the one or more sprayers to spray the liquid onto utensils disposed within the wash tub, and an air supply in fluid communication with the one or more sprayers and configured to supply pressurized air to the one or more sprayers to spray the pressurized air onto utensils disposed within the wash tub.

In some embodiments, the one or more sprayers includes a tubular spray element rotatable about a longitudinal axis thereof, the tubular spray element including one or more apertures extending through an exterior surface thereof, and the tubular spray element in fluid communication with the fluid supply to direct fluid from the fluid supply into the wash tub through the one or more apertures. In addition, some embodiments may further include a tubular spray element drive coupled to the tubular spray element and configured to discretely direct the tubular spray element to each of a plurality of rotational positions about the longitudinal axis thereof.

Also, in some embodiments, the one or more sprayers includes a rotatable spray arm, while in some embodiments, the one or more sprayers includes at least one nozzle. Further, in some embodiments, the nozzle is wall-mounted or rack-mounted, and the nozzle is fixed, rotating or oscillating.

Some embodiments may also include a hydraulic circuit coupled between the liquid supply, the air supply and the one or more sprayers. In addition, in some embodiments, the hydraulic circuit includes first and second check valves respectively configured to restrict back flow of liquid to the air supply and to restrict back flow of pressurized air to the liquid supply. In some embodiments, the hydraulic circuit includes a valve configured to selectively couple the one or more sprayers to each of the liquid supply and the air supply. In some embodiments, the one or more sprayers includes first and second sprayers, and the dishwasher further includes first and second valves respectively coupled to the first and second sprayers to control fluid flow to the first and second sprayers.

Some embodiments may also include a controller coupled to the liquid supply and the air supply. In addition, in some embodiments, the controller is configured to control the liquid supply, the air supply and/or the hydraulic circuit to selectively spray liquid or pressurized air through the one or more sprayers. Moreover, in some embodiments, the controller is configured to control the liquid supply, the air supply and/or the hydraulic circuit to spray liquid through the one or more sprayers during a wash operation of a wash cycle and to spray pressurized air through the one or more sprayers during a drying operation of the wash cycle.

In some embodiments, the controller is configured to control the liquid supply, the air supply and/or the hydraulic circuit to concurrently spray liquid and pressurized air through the one or more sprayers. In addition, in some embodiments, the controller is configured to dynamically vary a proportion of liquid and pressurized air supplied to the one or more sprayers by the liquid supply and the air supply to control a mechanical action produced by the one or more sprayers.

Some embodiments may further include one or more additional sprayers disposed in the wash tub and coupled in fluid communication with only one of the liquid supply or the air supply. In some embodiments, the liquid supply includes a pump that recirculates wash liquid within the wash tub.

Consistent with another aspect of the invention, a method of operating a dishwasher may include supplying liquid with a liquid supply of the dishwasher to one or more sprayers disposed in a wash tub of the dishwasher to spray the liquid onto utensils disposed within the wash tub, and supplying pressurized air with an air supply of the dishwasher to the one or more sprayers to spray the pressurized air onto utensils disposed within the wash tub.

In some embodiments, supplying the liquid and supplying the pressurized air are performed concurrently. In addition, in some embodiments, supplying the pressurized air includes injecting the pressurized air into the liquid supplied by the liquid supply. Some embodiments may also include dynamically varying a proportion of liquid and pressurized air supplied to the one or more sprayers by the liquid supply and the air supply to control a mechanical action of the one or more sprayers. Moreover, in some embodiments, supplying the liquid is performed during a wash operation of a wash cycle and supplying the pressurized air is performed during a drying operation of the wash cycle.

Consistent with another aspect of the invention, a dishwasher may include a wash tub, one or more sprayers disposed within the wash tub, and a hydraulic circuit in fluid communication with the one or more sprayers and configured to concurrently supply liquid and pressurized air to the one or more sprayers.

In addition, some embodiments may further include a liquid supply in fluid communication with the hydraulic circuit to supply the liquid to the hydraulic circuit and an air supply in fluid communication with the hydraulic circuit to supply the pressurized air to the hydraulic circuit. In some embodiments, the hydraulic circuit is configured to inject the pressurized air into the liquid supplied by the liquid supply. In addition, in some embodiments, the hydraulic circuit is configured to aerate the liquid supplied by the liquid supply using the pressurized air supplied by the air supply. Also, in some embodiments, the hydraulic circuit is configured to dynamically vary a proportion of liquid and pressurized air supplied to the one or more sprayers by the liquid supply and the air supply to control a mechanical action produced by the one or more sprayers.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

FIG. 24 is a perspective view of another dishwasher consistent with some embodiments of the invention.

FIG. 25 is a block diagram of hydraulic and electrical circuits of the dishwasher of FIG. 24.

FIG. 26 is a flowchart illustrating an example sequence of operations for concurrently supplying liquid and pressurized air through one or more sprayers in the dishwasher of FIGS. 24-25.

DETAILED DESCRIPTION

Figure 1:
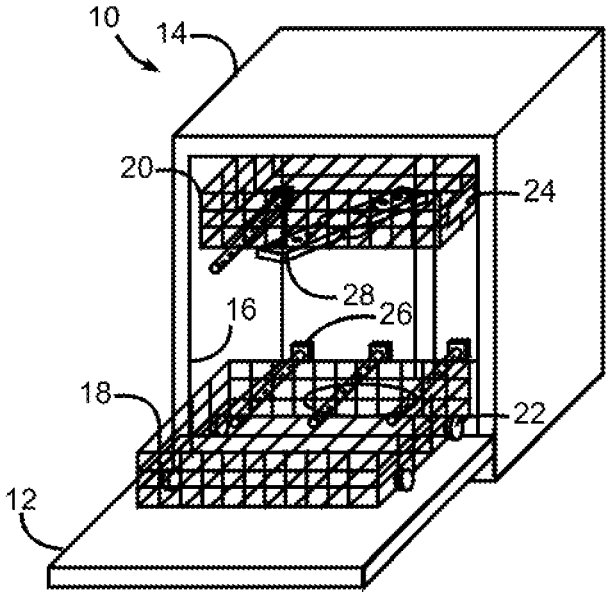
FIG. 1 is a perspective view of a dishwasher consistent with some embodiments of the invention.

In some embodiments consistent with the invention, one or more tubular spray elements may be discretely directed by one or more tubular spray element drives to spray a fluid such as a wash liquid and/or pressurized air into a wash tub of a dishwasher during a wash cycle. A tubular spray element, in this regard, may be considered to include an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates, and furthermore, a tubular spray element drive is coupled to the tubular spray element to discretely direct the tubular spray element to multiple rotational positions about the longitudinal axis. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, the exterior surface need not be formed by a single integral component.

In one embodiment, for example, a separate brushed or brushless DC motor may be used to drive a gear mechanism to rotate a respective tubular spray element, and each tubular spray element may be mounted to a base including a valve to shut off the flow and/or control the flow, e.g., a valve similar to a shutter in a camera or an iris valve that can be controlled by rotation in either direction, and in some instances also including the DC motor.

As will become more apparent below, the combination of a DC motor and a control valve dedicated to a tubular spray element opens up additional factors that can be adjusted to improve a dishwasher's efficiency, control and performance. The variables that may be controlled include, for example, tubular spray element speed, direction, and/or activation. In some embodiments, for general washing settings, all tubular spray elements may be open and spraying wash liquid at low speeds. Tubular spray elements located near wash tub walls may be controlled to rotate in a way not to directly spray wash liquid on the sides of the wash tub thus reducing the noise generated by the wash operation. Tubular spray elements in the center of the wash tub, however, may be allowed to rotate in all directions, and may alternate directions occasionally. A power zone may be created in some embodiments proximate a silverware basket by closing some of the tubular spray elements except for one or more elements proximate the silverware basket, thereby increasing the fluid pressure for power washing in the active tubular spray elements. In addition, in some embodiments the tubular spray elements may be controlled to rotate in a relatively small (e.g., about 5-10 degree) arc to concentrate spray in a small area/zone. Further, to increase efficiency, the tubular spray elements may also be cycled on and off to reduce the amount of wash liquid needed. In addition, it will be appreciated that the flow rate and/or pressure of a fluid supply may also be varied in some embodiments in connection with cycling tubular spray elements on and off, or otherwise as may be desirable in connection with dispensing fluid with a tubular spray element.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which wash fluid is sprayed by each of the tubular spray elements. In some embodiments, wash fluid may be dispensed solely through tubular spray elements, however the invention is not so limited. For example, as shown in FIG. 1, one or more rotating spray arms, e.g., upper spray arm 28, may also be provided to direct additional wash fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
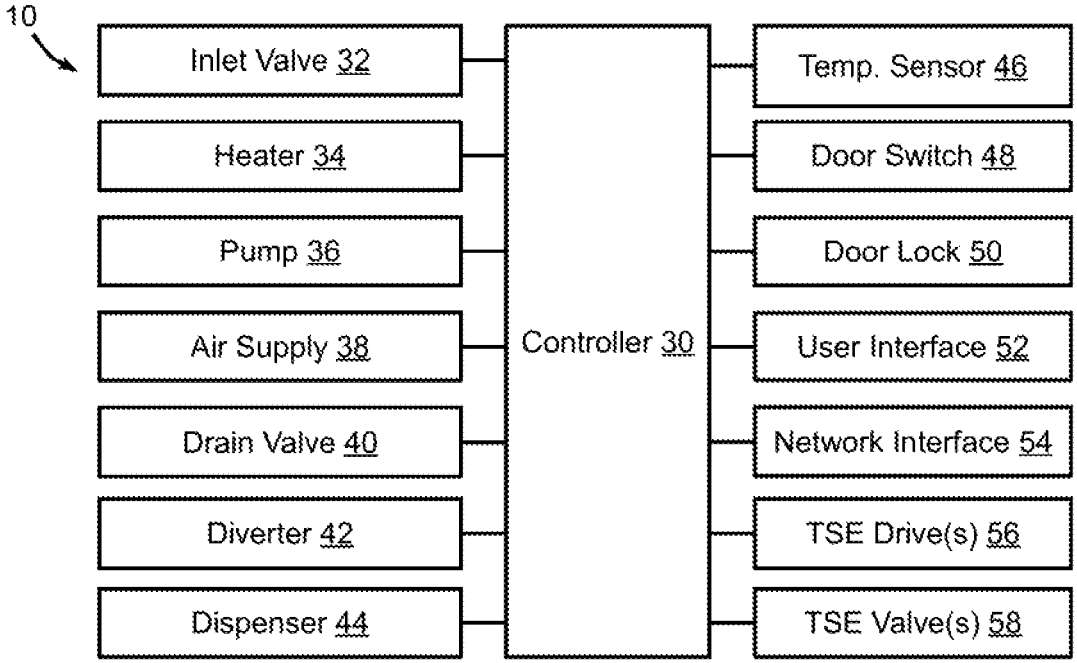
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more TSE drives 56 and/or one or more TSE valves 58 may be provided in some embodiments to discretely control one or more TSEs disposed in dishwasher 10, as will be discussed in greater detail below.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Figure 3:
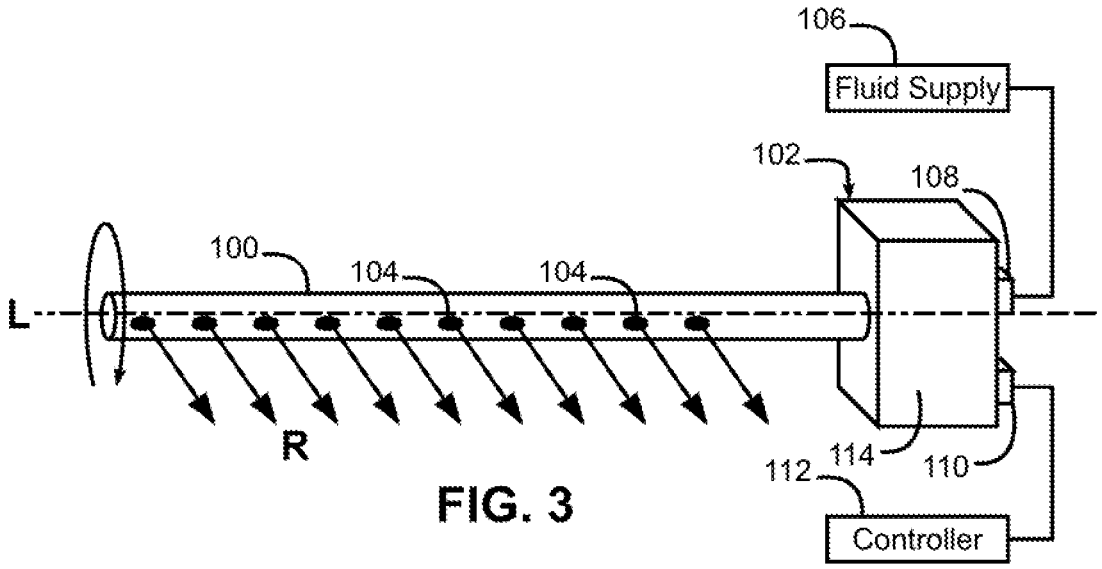
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about, 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in, different embodiments of the invention.

Figure 4:
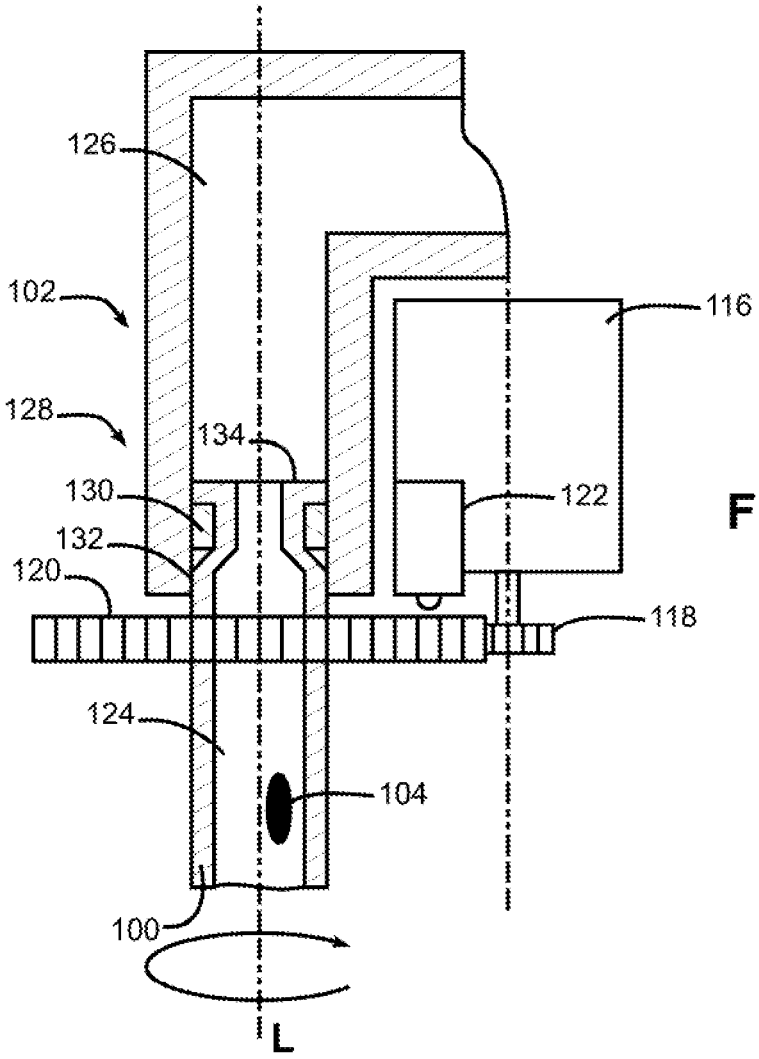
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pully drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
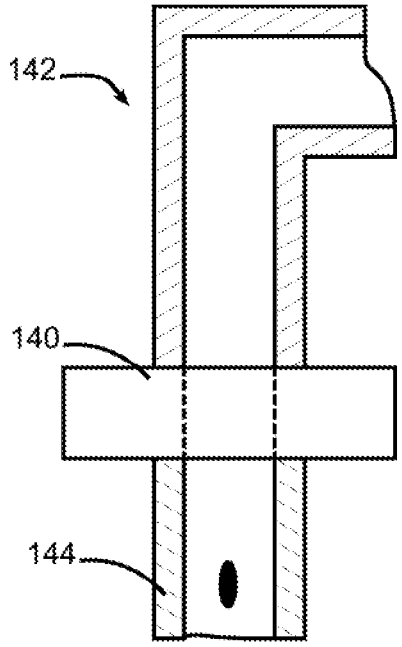
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disc, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may be close valve 140, e.g., where valve 140 includes an arcuate channel that permits fluid flow over only a range of rotational positions.

Figure 6:
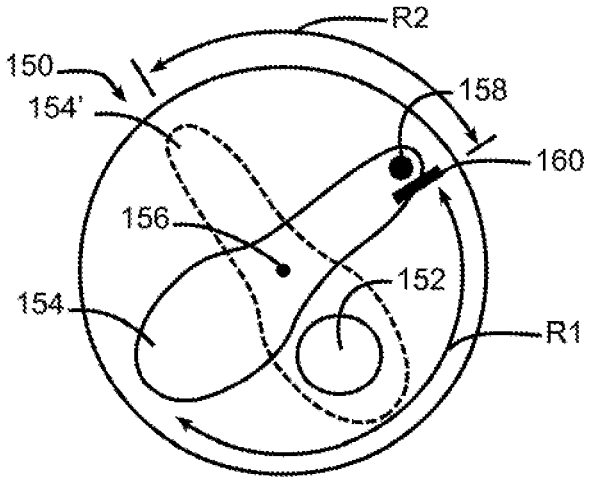
FIG. 6 is one example implementation of the valve referenced in FIG. 5.

As another example, and as illustrated by valve 150 of FIG. 6, a valve may be actuated through over-rotation of a tubular spray element. Valve 150, for example, includes a port 152 that is selectively shut by a gate 154 that pivots about a pin 156. Gate 154 is biased (e.g., via a spring) to the position shown via solid line in FIG. 6, and includes a leg 158 that selectively engages a stop 160 at a predetermined rotational position representing an end of a range R1 of active spray positions for the tubular spray element. When a tubular spray element is rotated beyond range R1, e.g., within range R2, leg 158 engages with stop 160 to pivot gate 154 to the position 154' shown in dotted line and seal port 152.

Figure 7:
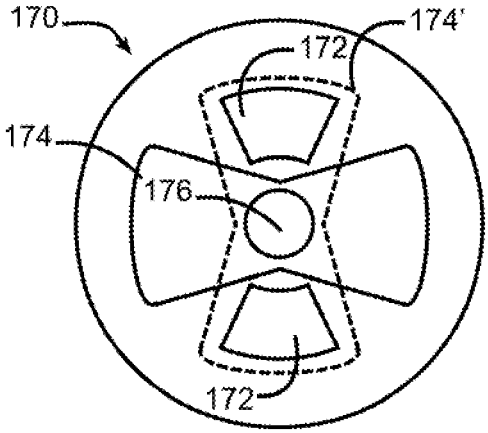
FIG. 7 is another example implementation of the valve referenced in FIG. 5.

As yet another example, and as illustrated by valve 170 of FIG. 7, a valve may be actuated through counter rotation of a tubular spray element. Valve 170, for example, includes a pair of ports 172 that are selectively shut by a gate 174 that pivots about a one way bearing 176. Gate 174 is biased (e.g., via a spring) to the position shown via solid line in FIG. 7, and when the tubular spray element is rotated in a clockwise direction, gate 174 is maintained in a position that permits fluid flow through ports 172. Upon counter-clockwise rotation, however, gate 174 is rotated to position 174' shown in dotted line to seal ports 172 through the action of one way bearing 176.

Figure 8:
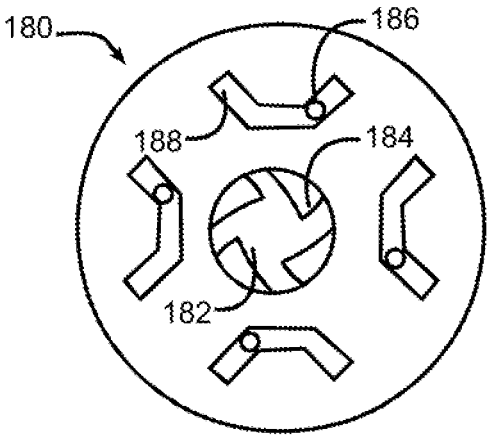
FIG. 8 is yet another first example implementation of the valve referenced in FIG. 5.

As yet another example, and as illustrated by valve 180 of FIG. 8, a valve 180 may be a variable valve, e.g., an iris valve, including a port 182 that is selectively regulated by a plurality of iris members 184. Each iris member 184 includes a pin 186 that rides in a track 188 to vary an opening size of port 182. Valve 180 may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages.

It should also be noted that with the generally U-shape of track 188, valve 180 may be configured in some embodiments to close through counter-rotation by a predetermined amount, yet still remain open when rotated in both directions. Specifically, valve 180 may be configured such that, the valve is open when pin 186 is disposed in either leg of the U-shaped track, but is closed when pin 186 is disposed in the central portion of the track having the shortest radial distance from the centerline of the valve. Valve 180 may be configured such that, when the tubular spray element is rotating in one direction and pin 186 is disposed at one end of track 188, the valve is fully open, and then when the tubular spray element is counter-rotated in an opposite direction a first predetermined amount (e.g., a predetermined number of degrees) the pin 186 travels along track 188 to the central portion to fully close the valve. Then, when the tubular spray element is counter-rotated in the opposite direction beyond the first predetermined about, the pin 186 continues to travel along track 188 to the opposite end, thereby reopening the valve such that the valve will remain open through continued rotation in the opposite direction.

Figure 9:
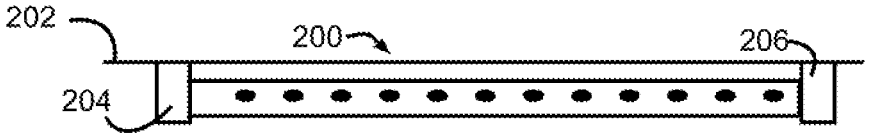
FIG. 9 is a functional top plan view of an example implementation of a wall-mounted tubular spray element and tubular spray element drive consistent with some embodiments of the invention.
Figure 10:
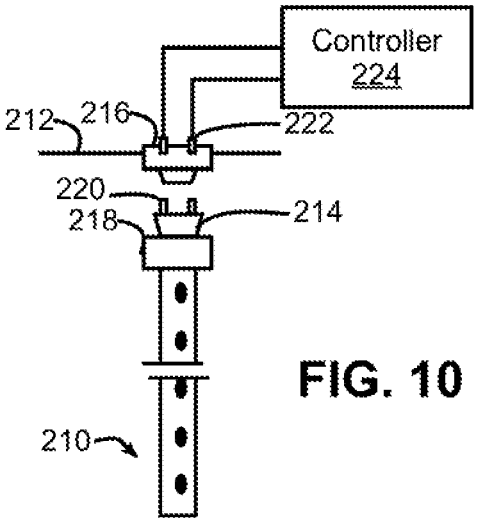
FIG. 10 is a functional top plan view of an example implementation of a rack-mounted tubular spray element and tubular spray element drive consistent with some embodiments of the invention.
Figure 11:
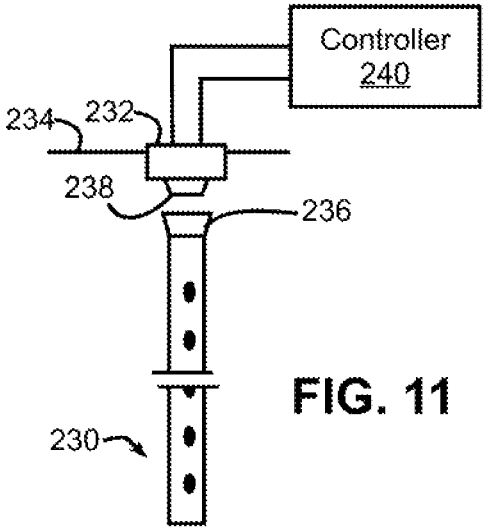
FIG. 11 is a functional top plan view of another example implementation of a rack-mounted tubular spray element and tubular spray element drive consistent with some embodiments of the invention.

Now turning to FIGS. 9-11, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 200 of FIG. 9, rather than being mounted in a cantilevered fashion as is the case with tubular spray element 100 of FIG. 3, a tubular spray element may also be mounted on a wall 202 of a wash tub and supported at both ends by hubs 204, 206, one or both of which may include the components of the tubular spray element drive. In this regard, the tubular spray element 200 runs generally parallel to wall 202 rather than running generally perpendicular thereto, as is the case with tubular spray element 100 of FIG. 3.

In still other embodiments, a tubular spray element may be rack-mounted. FIG. 10, for example, illustrates a tubular spray element 210 mountable on rack (not shown) and dockable via a dock 214 to a docking port 216 on a wall 212 of a wash tub. In this embodiment, a tubular spray element drive 218 is also rack-mounted, and as such, in addition to a fluid coupling between dock 214 and docking port 216, a plurality of cooperative contacts 220, 222 are provided on dock 214 and docking port 216 to provide power to tubular spray element drive 218 as well as electrical communication with a controller 224.

As an alternative, and as illustrated in FIG. 11, a tubular spray element 230 may be rack-mounted, but separate from a tubular spray element drive 232 that is not rack-mounted, but is instead mounted to a wall 234 of a wash tub. A dock 236 and docking port 238 provide fluid communication with tubular spray element 230, along with a capability to rotate tubular spray element 230 about its longitudinal axis under the control of tubular spray element drive 232. Control over tubular spray element drive 232 is provided by a controller 240. In some instances, tubular spray element drive 232 may include a rotatable and keyed channel into which an end of a tubular spray element may be received.

Figure 12:
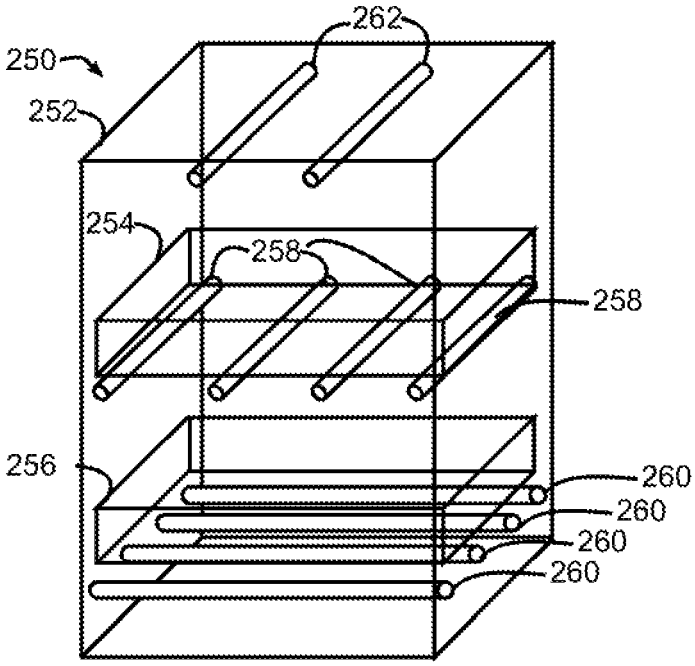
FIG. 12 is a functional perspective view of a dishwasher incorporating multiple tubular spray elements and consistent with some embodiments of the invention.

FIG. 12 next illustrates a dishwasher 250 including a wash tub 252 and upper and lower racks 254, 256, and with a number of tubular spray elements 258, 260, 262 distributed throughout the wash tub 252 for circulating a wash fluid through the dishwasher. Tubular spray elements 258 may be rack-mounted, supported on the underside of upper rack 254, and extending back-to-front within wash tub 252. Tubular spray elements 258 may also dock with back wall-mounted tubular spray element drives (not shown in FIG. 12), e.g., as discussed above in connection, with FIG. 11. In addition, tubular spray elements 258 may be rotatably supported at one or more points along their respective longitudinal axes by couplings (not shown) suspended from upper rack 254. Tubular spray elements 258 may therefore spray upwardly into upper rack 254 and/or downwardly onto lower rack 256, and in some embodiments, may be used to focus wash fluid onto a silverware basket or other region of either rack to provide for concentrated washing. Tubular spray elements 260 may be wall-mounted beneath lower rack 256, and may be supported at both ends on the side walls of wash tub 252 to extend in a side-to-side fashion, and generally transverse to tubular spray elements 258. Each tubular spray element 258, 260 may have a separate tubular spray element drive in some embodiments, while in other embodiments some or all of the tubular spray elements 258, 260 may be mechanically linked and driven by common tubular spray element drives.

In some embodiments, tubular spray elements 258, 260 by themselves may provide sufficient washing action and coverage. In other embodiments, however, additional tubular spray elements, e.g., tubular spray elements 262 supported above upper rack 254 on one or both of the top and back walls of wash tub 252, may also be used. In addition, in some embodiments, additional spray arms and/or other sprayers may be used. It will also be appreciated that while 10 tubular spray elements are illustrated in FIG. 12, greater or fewer numbers of tubular spray elements may be used in other embodiments.

Figure 13:
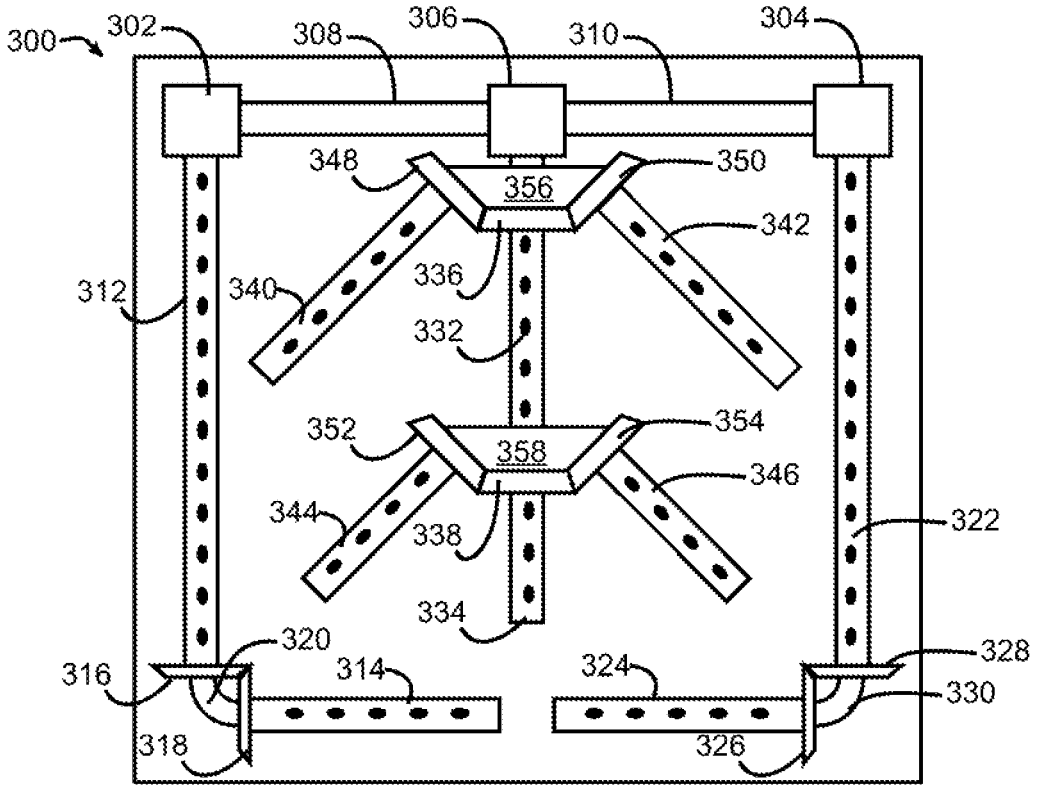
FIG. 13 is a functional top plan view of an example implementation of a plurality of mechanically coupled tubular spray elements consistent with some embodiments of the invention.

Next, as illustrated in FIG. 13, it may be desirable in some embodiments to drive multiple tubular spray elements using the same tubular spray element drive. An example dishwasher 300, for example, may include three tubular spray element drives 302, 304, 306 coupled to one another through fluid supply tubes 308, 310. Drive 302 may directly drive a tubular spray element 312 similar to drive 102 of FIG. 3, as well as an additional tubular spray element 314 that runs generally transverse to tubular spray element 312 and is mechanically connected through a mechanical coupling including a pair of gears 316, 318 and fluidly connected through a pipe 320. Similarly, drive 304 may directly drive a tubular spray element 322, as well as an additional tubular spray element 324 that runs generally transverse to tubular spray element 322 and is mechanically connected through a mechanical coupling including a pair of gears 326, 328 and fluidly connected through a pipe 330.

In addition, drive 306 may directly drive a pair of tubular spray elements 332, 334 that run along a similar longitudinal axis and that respectively include drive gears 336, 338. Coupled at about 45 degree angles to tubular spray elements 332, 334 are tubular spray elements 340, 342, 344 and 346 that are mechanically connected to gears 336, 338 via respective mechanical couplings including gears 348, 350, 352 and 354 and fluidly connected through headers 356, 358.

It will be appreciated that the configuration illustrated n FIG. 13 may be implemented at different elevations in a wash tub, e.g., at the bottom, at the top and/or in the middle, and may be mounted to a rack or to a wall of the wash tub. It will also be appreciated that an innumerable number of variations in terms of directions, numbers, and orientations of tubular spray elements may be supported in different embodiments. Further, it will be appreciated that in general, multiple tubular spray elements may be driven by the same tubular spray element drive, and that multiple tubular spray elements may be disposed within a wash tub and may extend in different directions and/or in different planes to provide greater coverage throughout the wash tub.

Figure 14:
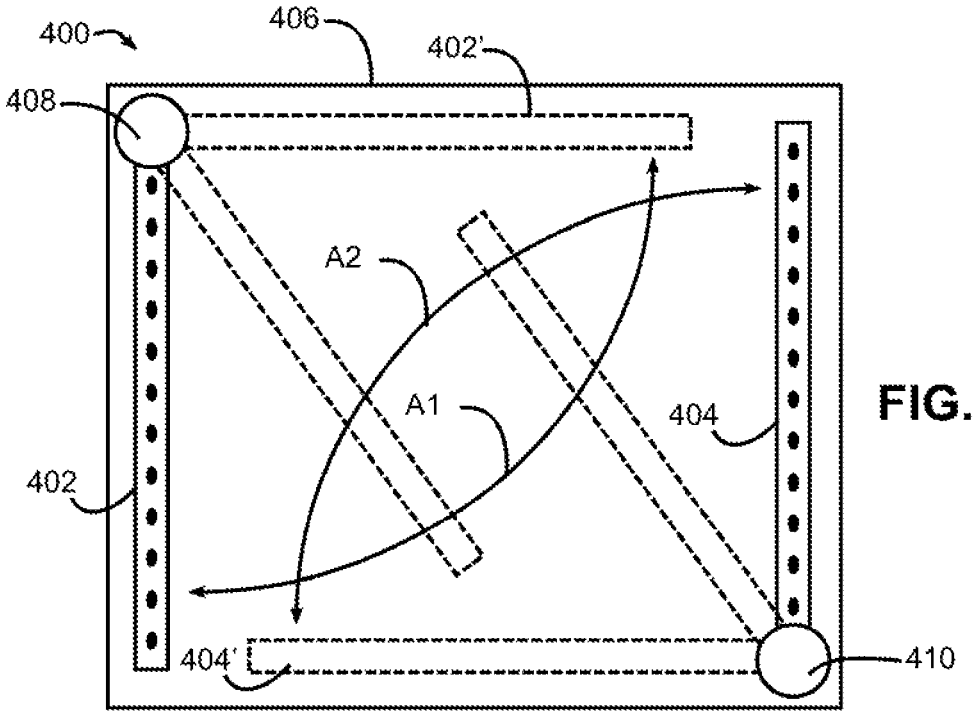
FIG. 14 is a functional top plan view of an example implementation of a tubular spray element that is additionally rotatable about a transverse axis consistent with some embodiments of the invention.
Figure 15:
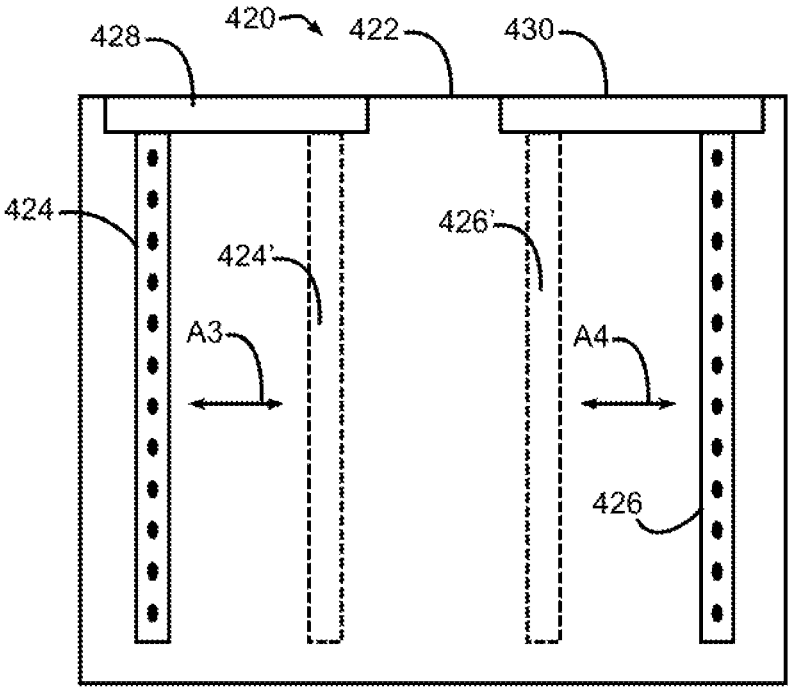
FIG. 15 is a functional top plan view of an example implementation of a tubular spray element that is additionally movable about a transverse axis consistent with some embodiments of the invention.

Next turning to FIGS. 14 and 15, it will be appreciated a tubular spray element may also be rotatable or otherwise movable in addition to rotating about its longitudinal axis in some embodiments of the invention, as well as in different planes. FIG. 14, for example, illustrates a dishwasher 400 including a wash tub 406 and first and second tubular spray elements 402, 404. Each tubular spray element 402, 404, in addition to rotating about its longitudinal axis, is also rotatable about a respective hub 408, 410 disposed in opposing corners of wash tub 406. Each hub 408, 410 defines an axis of rotation that is generally transverse to the longitudinal axis of the respective tubular spray element 402, 404, and the axis of rotation is disposed proximate one end of the respective tubular spray element 402, 404 such that an opposite end of the respective tubular spray element 402, 404 moves along an arcuate path A1, A2, e.g., to the positions 402', 404' shown in dotted lines.

It will be appreciated that each hub 408, 410 may include multiple tubular spray element drives, including one tubular spray element drive for rotating the tubular spray element 402, 404 about its longitudinal axis and one tubular spray element drive for rotating the tubular spray element 402, 404 about the transverse axis of rotation. In some embodiments, the two drives may also be interconnected and/or share common components (e.g., gears and/or motors). In other embodiments, tubular spray element drives for rotating about a longitudinal axis and/or rotating about a transverse axis of rotation may be separate from the hub 402, 404 and mechanically coupled in an appropriate manner that will be appreciated by those of ordinary skill having the benefit of the instant disclosure.

It will be appreciated that through the movement of tubular spray elements along paths A1, A2, substantially the entire cross-section of wash tub 406 may be covered, including the corners, thereby minimizing dead zones where insufficient spraying occurs. Furthermore, it will be appreciated that, in order to avoid collisions between tubular spray elements 402, 404, the tubular spray elements may be configured to rotate in different planes (e.g., at different elevations in the wash tub), or alternatively control of the position of each tubular spray element 402, 404 along paths A1, A2 may be coordinated to avoid collisions, even where the elements are in the same plane.

Now turning to FIG. 15, tubular spray elements may also be movable in addition to or in lieu of being rotatable as illustrated in FIG. 14. FIG. 15, in particular, illustrates a dishwasher 420 including a wash tub 422 and a pair of tubular spray elements 424, 426 that are supported on tracks 428, 430 to move generally linearly along an axis A3, A4, which is generally transverse to the longitudinal axis of the respective tubular spray element 424, 426 (e.g., to the positions 424', 426' shown in dotted lines). Each track 428, 430 may include multiple tubular spray element drives, including one tubular spray element drive for moving the tubular spray element 424, 426 about its longitudinal axis and one tubular spray element drive for moving the tubular spray element 424, 426 along the transverse axis A3, A4. In some embodiments, the two drives may also be interconnected and/or share common components (e.g., gears and/or motors). As one example, tracks 428, 430 may be configured to "roll" tubular spray elements 424, 426 like logs between the respective positions 424, 424' and 426, 426' using a single motor, and in some instances, valves may be configured to turn off fluid flow at certain rotational positions (e.g., to avoid hitting walls of the wash tub. In other embodiments, tubular spray element drives for rotating about a longitudinal axis and/or moving along a transverse axis may be separate from the track 428, 430 and mechanically coupled in an appropriate manner that will be appreciated by those of ordinary skill having the benefit of the instant disclosure.

Figure 16:
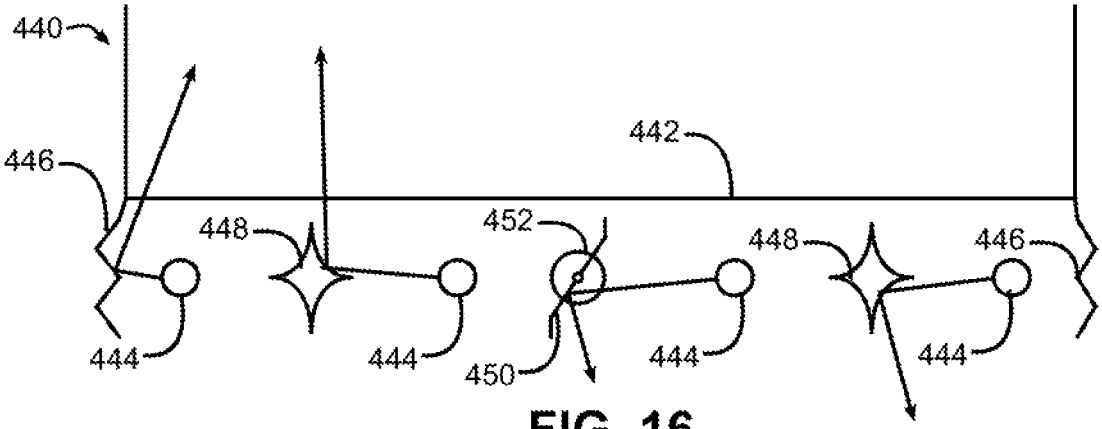
FIG. 16 is a functional front elevational view of an example tubular spray element system including various types of deflectors consistent with some embodiments of the invention.
Figure 17:
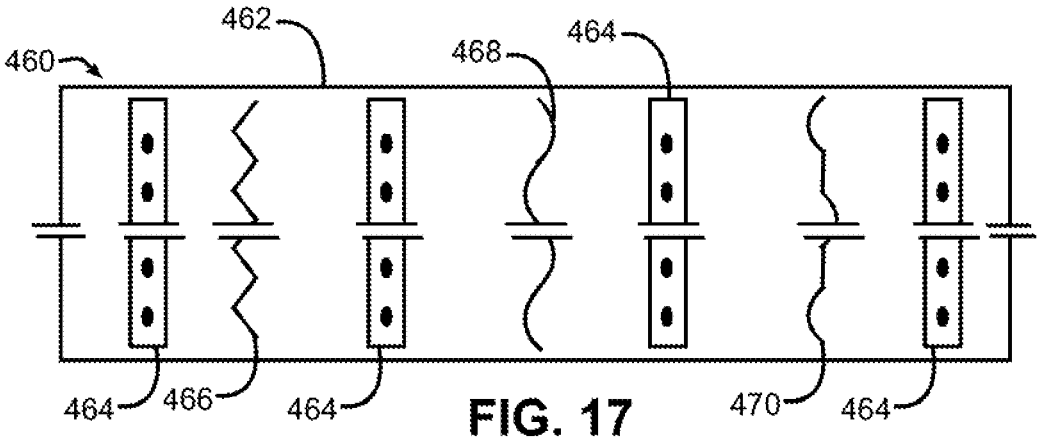
FIG. 17 is a functional partial top plan view of another example tubular spray element system including various types of deflectors consistent with some embodiments of the invention.

Now turning to FIGS. 16-17, in some embodiments deflectors may be used in combination with tubular spray elements to further the spread of fluid and/or prevent fluid from hitting tub walls. As illustrated in FIG. 16, for example, deflectors may have various profiles and shapes to achieve a good distribution of fluid. A dishwasher includes a rack 440, under which is disposed multiple tubular spray elements 444 (shown from their respective ends). Deflectors, e.g., deflectors 446, 448, and 450, may be used to address fluid distribution issues associated with having fixed spray devices. Deflectors 446, for example, may angular in shape and be used to restrict fluid from being directed to a wash tub wall, while deflectors 448 may have a star-shaped cross-section and may be usable by multiple tubular spray elements 444 to direct fluid either up into rack 442 or down into a lower rack (not shown) simply by directing the tubular spray element appropriately. Deflector 450 may be planar in nature and may enable one tubular spray element 444 to spray upwardly and another tubular spray element to spray downwardly.

In some embodiments, deflectors may be integrated into a rack, e.g., into the wires thereof as illustrated by deflectors 446, or may be mounted to or otherwise supported by a rack. Further, in some embodiments deflectors may be mounted to a wall of the wash tub, as is the case with deflectors 448 and 450. In addition, while the deflectors illustrated in FIGS. 16-17 are fixed in nature, deflectors may also be movable in some embodiments, e.g., to redirect fluid between multiple directions, e.g., as illustrated by deflector 450, which is coupled to a motor 452 capable of rotating deflector 450 about its longitudinal axis. In some embodiments, for example, the orientation a deflector may be controllable such that a spray of fluid directed at the deflector by a tubular spray element may be controllably redirected.

It will be appreciated that a multitude of different cross-section profiles may be used in a deflector, and may be specifically configured for specific applications. Moreover, as illustrated by dishwasher 460 of FIG. 17 (which is a top plan view), deflectors may also vary in profile along their lengths. Specifically, dishwasher 460 includes a wash tub 462 with multiple tubular spray elements 464, as well as multiple deflectors therebetween, e.g., deflectors 466, 468 and 470. Deflector 466 is corrugated along its length, while deflector 468 is curved along its shape. Deflector 470 has a combination of angles and curves. Other profiles may be used, as will be appreciated by those of ordinary skill having the benefit of the instant disclosure.

Next turning to FIGS. 18-23, while the prior embodiments discussed herein focused primarily on tubular spray elements for spraying wash fluid, e.g., wash liquid, onto utensils during a wash operation of a wash cycle, tubular spray elements may also be used in some embodiments to spray pressurized air at utensils during a drying operation of a wash cycle, e.g., to blow off water that pools on cups and dishes after rinsing is complete.

Figure 18:
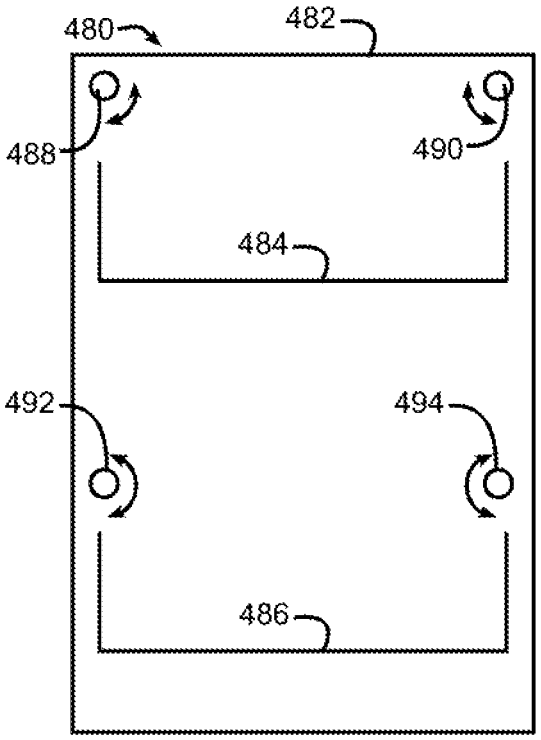
FIG. 18 is a functional front elevational view of an example tubular spray element system for emitting pressurized air during a drying operation of a wash cycle consistent with some embodiments of the invention.

As illustrated by dishwasher 480 of FIG. 18, for example, a wash tub 482 may include upper and lower racks, 484, 486 and a plurality of tubular spray elements 488, 490, 492 and 494 configured as "air knives" for spraying pressurized air during a drying operation. Tubular spray elements 488, 490 may be disposed above upper rack 484 in top corners of wash tub 482, and as such may be restricted to movement through about 90 degrees of rotation. Tubular spray elements 492, 494, on the other hand, are disposed between racks 484, 486 along sidewalls of wash tub 482, and are restricted to movement through about 180 degrees of rotation. In this embodiment, the tubular spray elements 488, 490, 492, 494 are dedicated to spraying pressurized air, and as such, may have apertures sizes and numbered as appropriate for their drying functionality. Additional tubular spray elements (not shown) may be used for spraying wash fluid in some embodiments, while in other embodiments, other sprayers, e.g., wall-mounted sprayers, spray arms, rack-mounted sprayers, etc., may be used.

Figure 19:
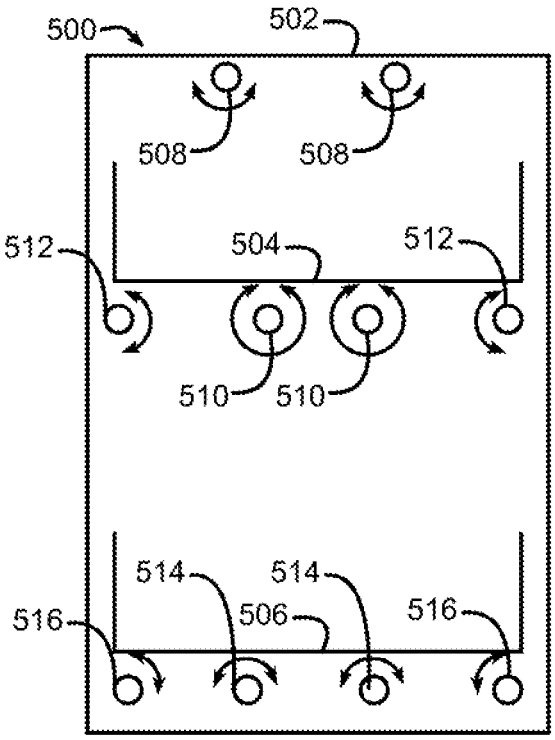
FIG. 19 is a functional front elevational view of an example dual use tubular spray element system for selectively emitting wash fluid or pressurized air during washing and drying operations of a wash cycle consistent with some embodiments of the invention.

Alternatively, as illustrated by dishwasher 500 of FIG. 19, tubular spray elements may be dual purpose, and may be used to spray both wash liquid and pressurized air for wash and drying operations in a wash cycle. A wash tub 502 includes upper and lower racks 504, 506, and above upper rack 504 is a pair of top tubular spray elements 508 configured to spray downwardly through about 180 degrees of rotation. Directly beneath upper rack 504 and above lower rack 506 is a pair of central tubular spray elements 510 configured for 360 degrees of rotation and a pair of sidewall tubular spray elements 512 configured for about 180 degrees of rotation. Beneath lower rack 506 is a pair of lower central tubular spray elements 514 configured for about 180 degrees of rotation, as well as a pair of lower corner tubular spray elements 516 configured for about 90 degrees of rotation. It will be appreciated that in some embodiments, tubular spray elements may also be arranged to extend from side to side in a wash tub rather than back to front, or in other orientations if desired.

Figure 20:
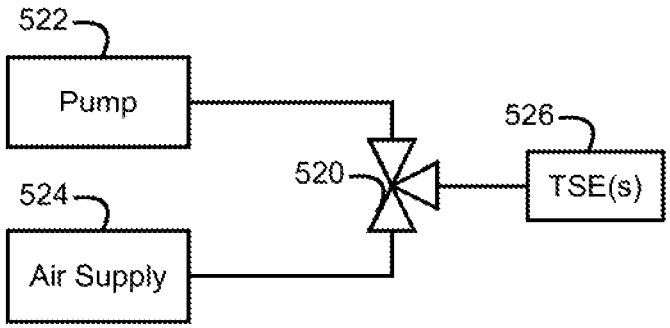
FIG. 20 is a block diagram illustrating an example implementation of a tubular spray element system capable of selectively spraying wash fluid and/or pressurized air consistent with some embodiments of the invention.

Each of tubular spray elements 508-516, or at least a subset of such tubular spray elements, is capable of being used to spray both wash fluid and pressurized air, either separately or in combination if so desired for a particular application. In order to support such dual use functionality, it may be desirable to include one or more valves intermediate the tubular spray elements and the pump and air supply of a dishwasher. FIG. 20, for example, illustrates one such arrangement whereby a three way valve 520 selectively couples one or both of a pump 522 and an air supply 524 to one or more tubular spray elements 526. Valve 520 may couple only one of pump 522 and air supply 524 to tubular spray elements 526 at a time in some embodiments, while in other embodiments, valve 520 may be configured to proportion flow between pump 522 and air supply 524.

Figure 21:
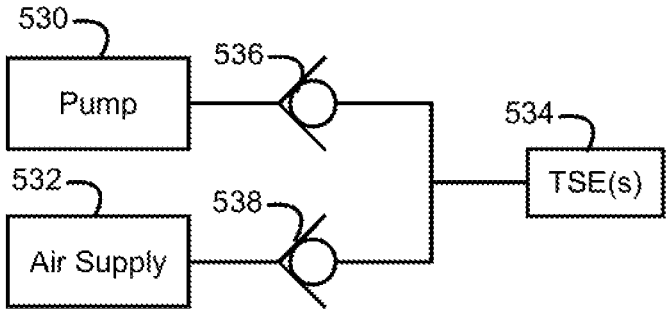
FIG. 21 is a block diagram illustrating another example implementation of a tubular spray element system capable of selectively spraying wash fluid and/or pressurized air consistent with some embodiments of the invention.

FIG. 21 illustrates an alternate arrangement whereby a pump 530 and air supply 532 are coupled to one or more tubular spray elements 534 through respective check valves 536, 538, such that pump 532 may be activated when it is desired to spray wash fluid, while air supply 534 may be activated when it is desired to spray pressurized air, with check valves 536, 538 preventing back flow into the other supply when that supply is inactive, while also permitting both supplies to be active concurrently in some embodiments if desired.

Figure 22:
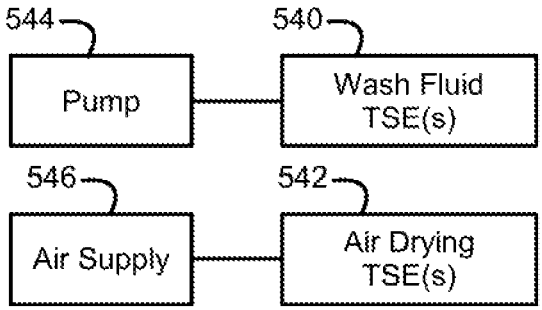
FIG. 22 is a block diagram illustrating yet another example implementation of a tubular spray element system capable of selectively spraying wash fluid and/or pressurized air consistent with some embodiments of the invention.

FIG. 22 illustrates another alternate arrangement whereby different subsets of tubular spray elements 540, 542 are respectively coupled to a pump 544 and an air supply 546. In such an arrangement, each of tubular spray elements 540, 542 may be optimized for their respective wash/drying functions, and no intermingling between pump 544 and air supply 546 may occur.

Figure 23:
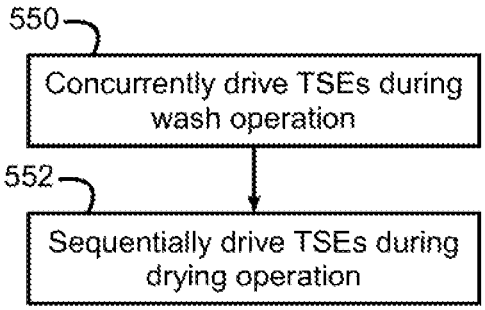
FIG. 23 is a flowchart illustrating an example sequence of operations for performing a wash cycle using a tubular spray element system consistent with some embodiments of the invention.

It will be appreciated that with the ability to shut off tubular spray elements individually as has been disclosed above, air pressure can generally be maintained at a higher level due to the reduction in volume required for drying by selectively shutting off some of the tubular spray elements. Otherwise, with all tubular spray elements active at the same time during a drying operation, the amount of air flow required may necessitate the use of a higher volume air pump or fan in the air supply in order to generate enough air movement to forcibly move pooled water on any utensils. Such concerns may not be as great during a wash operation due to the comparatively greater volume of wash liquid that can be sprayed during a wash operation. Thus, in some embodiments, it may be desirable to concurrently operate multiple tubular spray elements during a wash operation while sequentially operating those tubular spray elements during a drying operation. FIG. 23, for example, illustrates one such sequence of operations for a dishwasher controller wash cycle, whereby during a wash operation (block 550) multiple tubular spray elements may be operated concurrently to spray wash liquid into a wash tub, while during a drying operation (block 552) the same tubular spray elements may be operated sequentially or individually to spray pressurized air into the wash tub, thereby reducing the maximum volume of air required to be supplied at any given instance during the drying operation.

Now turning to FIGS. 24-26, while various embodiments discussed above disclose in part the supply of both liquid and pressurized air to one or more tubular spray elements, one of ordinary skill will also readily appreciate that the techniques discussed herein may also be utilized in connection with sprayers other than tubular spray elements. FIG. 24, for example, illustrates a dishwasher 600 including a wash tub 602, a door 604, an upper rack 606, and a lower rack 608. Various types of sprayers may also be utilized in such a dishwasher for washing utensils, as well as for addressing particular washing needs. For example, some dishwasher designs may utilize rotatable spray arms, e.g., a middle rotatable spray arm 610 and/or a lower rotatable spray arm 612 disposed underneath upper rack 606 and lower rack 608, respectively. Some designs may also include an upper rotatable spray arm (not visible in FIG. 24) disposed on the top wall of wash tub 602. In addition, some dishwasher designs may include, in addition to or in lieu of rotatable spray arms, various sprayers or nozzles, e.g., various wall-mounted nozzles 614 and/or various rack-mounted nozzles 616. Some sprayers or nozzles may be fixed, while others may be rotatable, oscillating or otherwise movable to provide a varying spray pattern. In addition, some sprayers or nozzles may be configured for general coverage in an area of a wash tub, while some may provide more intensified and/or concentrated spraying, and some may be dedicated to a specific task (e.g., spraying items in a silverware basket, the interiors of bottles, the surfaces of extremely dirty cookware, etc.). In addition, in some embodiments, tubular spray elements may also be considered to be sprayers for the purposes of this aspect of the invention.

As shown in FIG. 25, and consistent with some embodiments of the invention, these various types of sprayers (collectively denoted at 620) may also be coupled to both a liquid supply 622 (e.g., a pump) and an air supply 624 through a hydraulic circuit 626 that enables both liquid (e.g., a wash liquid) and pressurized air to be sprayed onto utensils in the wash tube through the sprayers. The hydraulic circuit 626 may include one or more supply tubes, conduits, splitters, etc. as well as one or more valves, e.g., any of the various types of valves discussed above, including check valves as well as various valves controllable by a controller 628 that may also control each of liquid supply 622 and air supply 624 (electrical connections are denoted by dashed lines). Portions of hydraulic circuit 626 may also be integrated into any of liquid supply 622, air supply 624 and/or one or more sprayers 620. In some embodiments, a hydraulic circuit may be configured to inject pressurized air from air supply 624 into a flow of liquid from liquid supply 622, although the invention is not so limited. Moreover, the hydraulic circuit may incorporate many of the various arrangements discussed above in connection with FIGS. 20-23. It will also be appreciated that hydraulic circuit 626 may also be capable of communicating fluid to only portions of the sprayers 620 and/or to communicate different fluid compositions to different sprayers or combinations of sprayers at the same time, and that some additional sprayers in dishwasher 600 may be independent of hydraulic circuit 626 altogether.

In some embodiments, controller 628 may control liquid supply 622, air supply 624 and/or hydraulic circuit 626 to selectively spray liquid or pressurized air through sprayers 620, i.e., to spray liquid from liquid supply 622 or spray pressurized air from air supply 624, but not both at the same time. It may be desirable, for example, as discussed above, to utilize a sprayer to spray liquid from liquid supply 622 in a wash operation of a wash cycle, while spraying pressurized air from air supply 624 during a drying operation of the wash cycle.

In addition, in some embodiments, controller 628 may control liquid supply 622, air supply 624 and/or hydraulic circuit 626 to concurrently spray both liquid and pressurized air through sprayers 620, i.e., to spray liquid from liquid supply 622 and spray pressurized air from air supply 624 at substantially the same time. Doing so may effectively aerate the wash liquid in some embodiments, and in some embodiments, doing so may reduce water consumption. Further, in some embodiments, doing so may enable the mechanical action of a sprayer to be varied or controlled.

The control by controller 628 may incorporate control over hydraulic circuit 626, e.g., by switching one or more valves on or off, changing a position of a mixing or variable valve, changing the routing of fluid between two different endpoints, etc. Controller 628 may also incorporate control over each of liquid supply 622 and air supply 624, e.g., by turning either supply 622, 624 on or off, by changing a pressure or flow rate of either supply 622, 624, or changing some other parameter of either supply 622, 624 (e.g., temperature, introduction of additives, etc., if so supported). It will also be appreciated that in some embodiments, e.g., where check valves are used as disclosed in FIG. 21, a hydraulic circuit may be completely passive so no control by controller 628 over any component of hydraulic circuit 626 may be supported.

It may also be desirable in some embodiments when concurrently supplying liquid and pressurized air to dynamically vary a proportion of liquid and pressurized air supplied to the sprayers, e.g., to control a mechanical action of a sprayer. As illustrated in FIG. 26, for example, controller 628 may be configured to, when concurrently supplying liquid and pressurized air to one or more sprayers (block 640), dynamically vary the proportion of liquid and air to control the output of one or more sprayers (block 642). Such varying may incorporate, for example, temporarily switching the liquid and/or air supplies and/or valves coupled thereto on or off to communicate alternating bursts of liquid and/or pressurized air, varying a mixing valve to vary the proportion of liquid and pressurized air being communicated, changing an output, flow rate and/or pressure of either or both supplies 622, 624, or in other manners that will be appreciated by those of ordinary skill in the art. For example, it may be desirable in some instances to pulse an injection of pressurized air into a stream of wash liquid to create bursts of higher velocity wash liquid out of a sprayer.

Various additional modifications may be made to the illustrated embodiments consistent with the invention. Therefore, the invention lies in the claims hereinafter appended.

What is claimed is:

1. A dishwasher, comprising:

a wash tub;

one or more sprayers disposed within the wash tub, wherein the one or more sprayers includes a tubular spray element rotatable about a longitudinal axis thereof, the tubular spray element including one or more apertures extending through an exterior surface thereof;

a liquid supply in fluid communication with the one or more sprayers and configured to supply a liquid to the one or more sprayers to spray the liquid onto utensils disposed within the wash tub;

an air supply in fluid communication with the one or more sprayers and configured to supply pressurized air to the one or more sprayers to spray the pressurized air onto utensils disposed within the wash tub; and a tubular spray element drive coupled to the tubular spray element and configured to discretely direct the tubular spray element to each of a plurality of rotational positions about the longitudinal axis thereof when spraying at least one of liquid or pressurized air onto utensils disposed within the tub.

2. The dishwasher of claim 1, wherein the one or more sprayers includes a rotatable spray arm.

3. The dishwasher of claim 1, wherein the one or more sprayers includes at least one nozzle.

4. The dishwasher of claim 3, wherein the nozzle is wall-mounted or rack-mounted, and wherein the nozzle is fixed, rotating or oscillating.

5. The dishwasher of claim 1, further comprising a hydraulic circuit coupled between the liquid supply, the air supply and the one or more sprayers.

6. The dishwasher of claim 5, wherein the hydraulic circuit includes first and second check valves respectively configured to restrict back flow of liquid to the air supply and to restrict back flow of pressurized air to the liquid supply.

7. The dishwasher of claim 5, wherein the hydraulic circuit includes a valve configured to selectively couple the one or more sprayers to each of the liquid supply and the air supply.

8. The dishwasher of claim 5, wherein the one or more sprayers includes first and second sprayers, the dishwasher further comprising first and second valves respectively coupled to the first and second sprayers to control fluid flow to the first and second sprayers.

9. The dishwasher of claim 5, further comprising a controller coupled to the liquid supply and the air supply.

10. The dishwasher of claim 9, wherein the controller is configured to control the liquid supply, the air supply and/or the hydraulic circuit to selectively spray liquid or pressurized air through the one or more sprayers.

11. The dishwasher of claim 10, wherein the controller is configured to control the liquid supply, the air supply and/or the hydraulic circuit to spray liquid through the one or more sprayers during a wash operation of a wash cycle and to spray pressurized air through the one or more sprayers during a drying operation of the wash cycle.

12. The dishwasher of claim 9, wherein the controller is configured to control the liquid supply, the air supply and/or the hydraulic circuit to concurrently spray liquid and pressurized air through the one or more sprayers.

13. The dishwasher of claim 9, wherein the controller is configured to dynamically vary a proportion of liquid and pressurized air supplied to the one or more sprayers by the liquid supply and the air supply to control a mechanical action produced by the one or more sprayers.

14. The dishwasher of claim 1, further comprising one or more additional sprayers disposed in the wash tub and coupled in fluid communication with only one of the liquid supply or the air supply.

15. The dishwasher of claim 1, wherein the liquid supply comprises a pump that recirculates wash liquid within the wash tub.

16. The dishwasher of claim 5, wherein the hydraulic circuit is configured to inject the pressurized air from the air supply into the liquid supplied by the liquid supply.

17. The dishwasher of claim 5, wherein the hydraulic circuit is configured to aerate the liquid supplied by the liquid supply using the pressurized air supplied by the air supply.

18. The dishwasher of claim 9, wherein the controller is further configured to control the tubular spray element drive to focus a spray of the tubular spray element between multiple rotational positions.

19. A dishwasher, comprising:

a wash tub;

one or more sprayers disposed within the wash tub, the one or more sprayers including a discretely directable sprayer;

a liquid supply in fluid communication with the one or more sprayers and configured to supply a liquid to the one or more sprayers to spray the liquid onto utensils disposed within the wash tub;

an air supply in fluid communication with the one or more sprayers and configured to supply pressurized air to the one or more sprayers to spray the pressurized air onto utensils disposed within the wash tub; and a drive coupled to the discretely directable sprayer and configured to discretely direct the sprayer to each of a plurality of positions when spraying at least one of liquid or pressurized air onto utensils disposed within the tub.

20. The dishwasher of claim 19, wherein the discretely directable sprayer comprises a tubular spray element rotatable about a longitudinal axis thereof, the tubular spray element including one or more apertures extending through an exterior surface thereof, and wherein the drive comprises a tubular spray element drive coupled to the tubular spray element to each of a plurality of rotational positions about the longitudinal axis thereof when spraying at least one of liquid or pressurized air onto utensils disposed within the tub.

21. The dishwasher of claim 19, wherein the one or more sprayers includes a rotatable spray arm.

22. The dishwasher of claim 19, wherein the one or more sprayers includes at least one nozzle, wherein the nozzle is wall-mounted or rack-mounted, and wherein the nozzle is fixed, rotating or oscillating.

23. The dishwasher of claim 19, further comprising a hydraulic circuit coupled between the liquid supply, the air supply and the one or more sprayers, wherein the hydraulic circuit includes first and second check valves respectively configured to restrict back flow of liquid to the air supply and to restrict back flow of pressurized air to the liquid supply.

24. The dishwasher of claim 19, further comprising a hydraulic circuit coupled between the liquid supply, the air supply and the one or more sprayers, wherein the hydraulic circuit includes a valve configured to selectively couple the one or more sprayers to each of the liquid supply and the air supply.

25. The dishwasher of claim 19, wherein the one or more sprayers includes first and second sprayers, the dishwasher further comprising first and second valves respectively coupled to the first and second sprayers to control fluid flow to the first and second sprayers.

26. The dishwasher of claim 19, further comprising a hydraulic circuit coupled between the liquid supply, the air supply and the one or more sprayers and a controller coupled to the liquid supply and the air supply, wherein the controller is configured to control the liquid supply, the air supply and/or the hydraulic circuit to selectively spray liquid or pressurized air through the one or more sprayers, and wherein the controller is configured to control the liquid supply, the air supply and/or the hydraulic circuit to spray liquid through the one or more sprayers during a wash operation of a wash cycle and to spray pressurized air through the one or more sprayers during a drying operation of the wash cycle.

27. The dishwasher of claim 19, further comprising a hydraulic circuit coupled between the liquid supply, the air supply and the one or more sprayers and a controller coupled to the liquid supply and the air supply, wherein the controller is configured to control the liquid supply, the air supply and/or the hydraulic circuit to concurrently spray liquid and pressurized air through the one or more sprayers.

28. The dishwasher of claim 19, further comprising a hydraulic circuit coupled between the liquid supply, the air supply and the one or more sprayers and a controller coupled to the liquid supply and the air supply, wherein the controller is configured to dynamically vary a proportion of liquid and pressurized air supplied to the one or more sprayers by the liquid supply and the air supply to control a mechanical action produced by the one or more sprayers.

* * * * *